US007133635B2

(12) United States Patent
Chung et al.

(10) Patent No.: US 7,133,635 B2
(45) Date of Patent: Nov. 7, 2006

(54) FUSING UNIT USED WITH A COLOR LASER PRINTER

(75) Inventors: Kyung-shig Chung, Suwon-si (KR); Se-hyun Lyu, Seoul (KR); Young-min Yoon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 71 days.

(21) Appl. No.: 10/805,447

(22) Filed: Mar. 22, 2004

(65) Prior Publication Data

US 2005/0008411 A1 Jan. 13, 2005

(30) Foreign Application Priority Data

Jul. 11, 2003 (KR) ..... 10-2003-0047412

(51) Int. Cl.
*G03G 15/20* (2006.01)

(52) U.S. Cl. ..... 399/328; 399/330; 399/331

(58) Field of Classification Search ..... 399/176, 399/328, 279, 313, 330, 332; 384/127, 192, 384/218, 536; 219/652, 640
See application file for complete search history.

(56) References Cited

U.S. PATENT DOCUMENTS

| | | | | |
|---|---|---|---|---|
| 3,015,304 | A * | 1/1962 | Carlson et al. | 399/154 |
| 4,496,232 | A * | 1/1985 | Guzik | 399/143 |
| 4,984,027 | A * | 1/1991 | Derimiggio et al. | 399/331 |
| 5,196,895 | A * | 3/1993 | Setoriyama et al. | 399/328 |
| 5,662,950 | A * | 9/1997 | Kusago | 425/367 |
| 6,269,230 | B1 * | 7/2001 | Kiuchi | 399/122 |
| 2002/0136562 | A1 * | 9/2002 | Hiroki et al. | 399/69 |
| 2004/0062570 | A1 * | 4/2004 | Hachisuga | 399/226 |

* cited by examiner

*Primary Examiner*—David M. Gray
*Assistant Examiner*—Ryan D. Walsh
(74) *Attorney, Agent, or Firm*—Stanzione & Kim, LLP

(57) ABSTRACT

A fusing unit used with a color laser printer includes a pair of rollers which heat and press a sheet of paper, onto which an image is transferred, and fuse the transferred image on the sheet of paper, and plastic mold bearings which rotatably support the rollers to be centered on frames.

23 Claims, 5 Drawing Sheets

FUSING UNIT USED WITH A COLOR LASER PRINTER

CROSS-REFERENCE TO RELATED APPLICATIONS

This application claims the priority of Korean Patent Application No. 2003-47412, filed on Jul. 11, 2003, in the Korean Intellectual Property Office, the disclosure of which is incorporated herein in its entirety by reference.

QBACKGROUND OF THE INVENTION

1. Field of the Invention

The present invention relates to a fusing unit to heat and press a toner image transferred onto paper, and more particularly, to a fusing unit used with a color laser printer.

2. Description of the Related Art

In general, color laser printers develop an electrostatic latent image formed on a photosensitive body with toner in a powder state, transfer the developed image onto paper, heat and press the transferred image, and fuse the heated and pressed image on the paper. A fusing unit of the color laser printers which performs a fusing operation has a structure schematically shown in FIG. 1. Two rollers 10 and 20, in which heaters 11 and 21 are respectively disposed, are in close contact with each other and rotate while a sheet of paper 1 passes therebetween. In this procedure, a toner image formed on the sheet of paper 1 is heated by heat generated by the heaters 11 and 21 and pressed by an adhesion force formed between the two rollers 10 and 20, and then is completely fused on the sheet of paper 1. In general, an upper roller 10 is referred to as a heat roller, and a lower roller 20 that is in close contact with the heat roller 10 by a spring 25 is referred to as a pressure roller. Outer circumferences of aluminum cores 12 and 22 of the heat roller 10 and the pressure roller 20 are respectively covered with silicon rubber layers 13 and 23, and Teflon layers 14 and 24 are respectively coated on the silicon rubber layers 13 and 23.

In the conventional color laser printer, metallic ball bearings 30, as shown in FIG. 2, are generally used to support the heat roller 10 and the pressure roller 20. In other words, the cores 12 and 22, acting as rotating axes of the two rollers 10 and 20, are rotatably supported to be centered on a frame 40 via a respective metallic ball bearing 30 and are rotated by a motor (not shown).

However, in addition to high manufacturing costs, since it is difficult to process the metallic ball bearings 30, the metallic ball bearings 30 are formed into a ring-shape. Thus, a support structure to support the metallic ball bearings 30 is defined by a circular hole indicated by a reference numeral 41 shown in FIG. 2. As printers recently become smaller, the shape of a fusing unit also becomes very complicated and compact in consideration of shapes of other peripheral structures and a combinational relationship therebetween. To this end, the shape of a frame 40, in which a support structure is provided, needs to be optimized. However, due to the restriction on the shape of the metallic ball bearings 30, it is difficult to optimize the shape of the frame 40 and to implement a compact fusing unit.

SUMMARY OF THE INVENTION

In order to solve the foregoing and/or other problems, it is an aspect of the present invention to provide a fusing unit used with a color laser printer, the fusing unit having an appropriate and inexpensive structure which can accommodate different types of bearings.

Additional aspects and advantages of the invention will be set forth in part in the description which follows and, in part, will be obvious from the description, or may be learned by practice of the invention.

In order to achieve the foregoing and/or other aspects of the present invention, there is provided a fusing unit used with a color laser printer, the fusing unit passing a sheet of paper, onto which an image is transferred, between two rollers that are in close contact with each other and rotated, heating and pressing the transferred image, and fusing the heated and pressed image on the sheet of paper, wherein the two rollers are rotatably supported to be centered on predetermined frames by interposing bearings between the frames and respective rollers, and the bearings are plastic mold bearings.

BRIEF DESCRIPTION OF THE DRAWINGS

These and/or other aspects and advantages of the present invention will become apparent and more readily appreciated from the following description of the embodiments, taken in conjunction with the accompanying drawings of which FIG. 1 schematically illustrates a structure of a conventional fusing unit of a color laser printer.

DETAILED DESCRIPTION OF THE PREFERRED EMBODIMENTS

Figure 1:
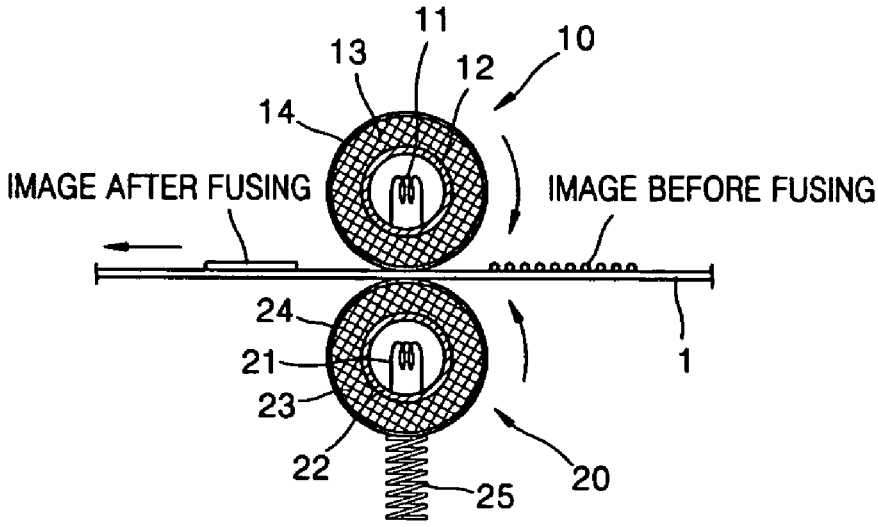
FIG. 1 (PRIOR ART)

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
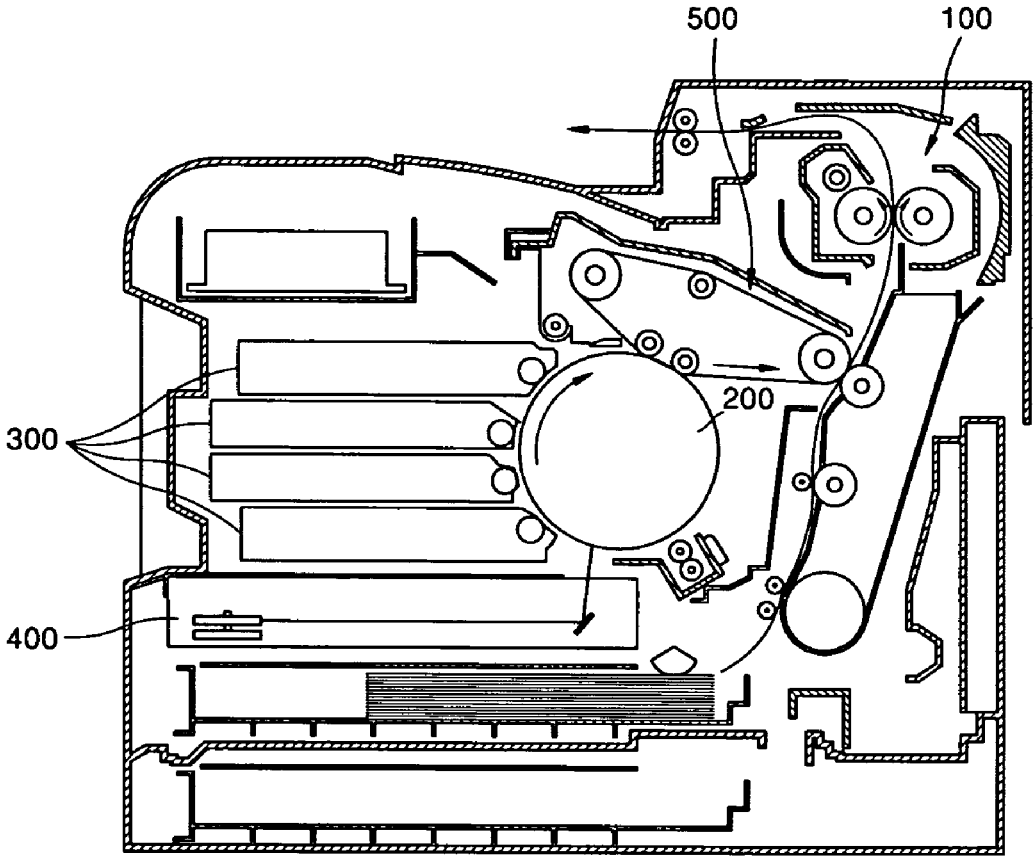
FIG. 3 schematically illustrates an internal structure of a color laser printer using a fusing unit according to an embodiment of the present invention.

FIG. 3 schematically illustrates an internal structure of a color laser printer using a fusing unit according to an aspect of the present invention.

As shown in FIG. 3, the color laser printer includes an exposure unit 400 which forms an electrostatic latent image on a photosensitive body 200, a developing unit 300 which develops the electrostatic latent image with four color toners, such as yellow, magenta, cyan, and black, a transfer unit 500 which transfers the developed image onto a sheet of paper, and a fusing unit 100 which heats and presses the sheet of paper to completely fuse the images.

Figure 4:
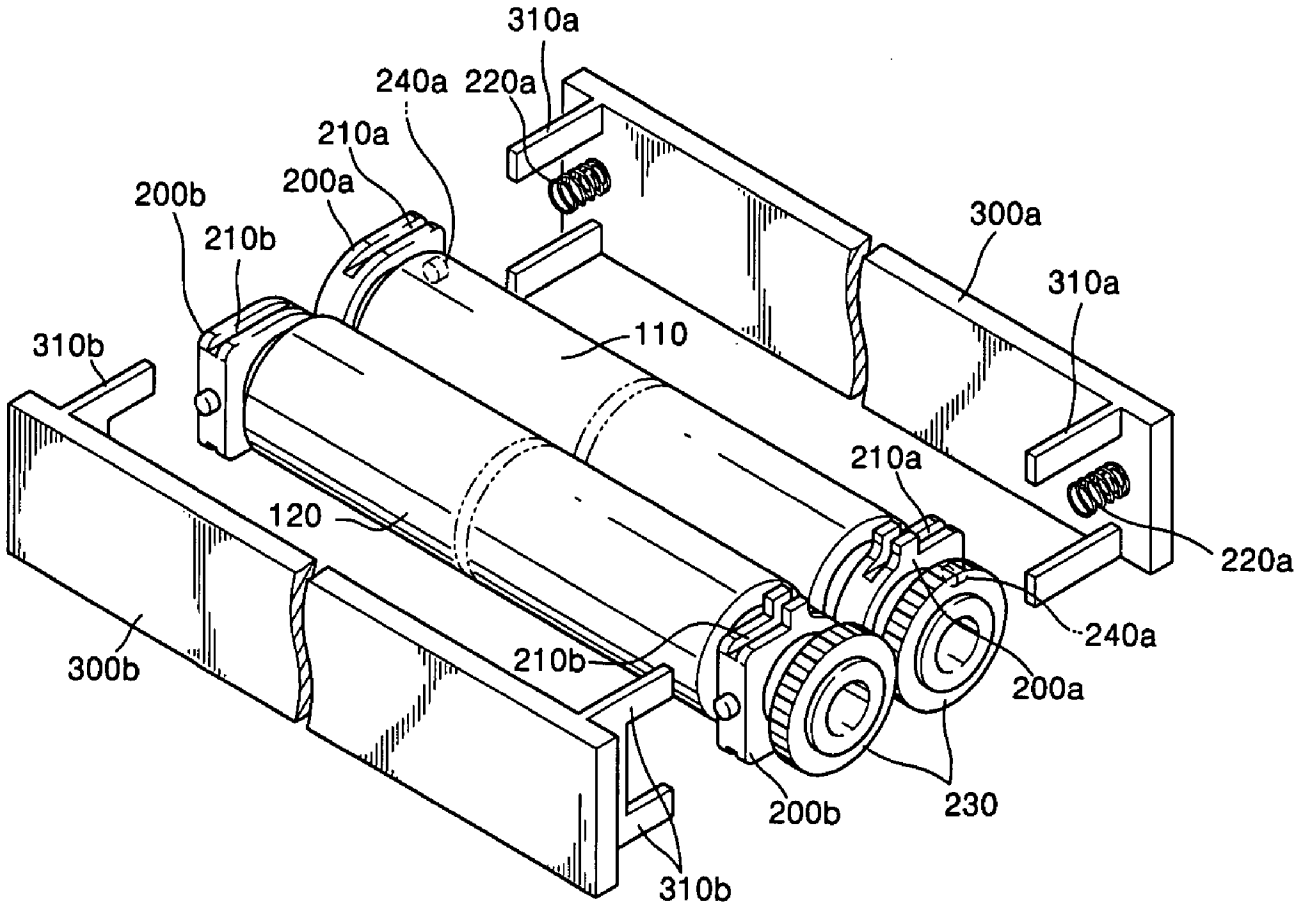
FIG. 4 illustrates the fusing unit of the color laser printer shown in FIG. 3.
Figure 5:
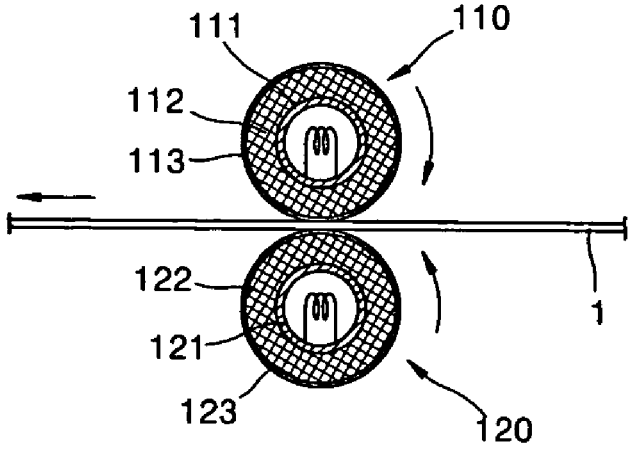
FIG. 5 illustrates a structure of a heat roller and a pressure roller in the fusing unit shown in FIG. 4.

A structure of the fusing unit 100 is shown in FIG. 4. As shown in FIG. 4, two rollers 110 and 120 are arranged in the fusing unit 100 so that they elastically and closely contact each other by a spring 220*a* and are rotated when a sheet of paper (1 of FIG. 5) passes therebetween. Hereinafter, the roller 110 is referred to as a heat roller 110, and the roller 120 is referred to as a pressure roller 120. Outer circumferences of aluminum cores 111 and 121 of the heat roller 110 and the pressure roller 120 are respectively covered with silicon rubber layers 112 and 122, and Teflon layers 113 and 123 are respectively coated on the silicon rubber layers 112 and 122, as shown in FIG. 5. In general, in a case of a black and white printer which prints only a single color, only one (usually, pressure roller 120) of the heat roller 110 and the pressure roller 120 is coated with a corresponding one of the silicon rubber layers 112 and 122 while the other roller (heat roller 110) is maintained in a metallic state. However, in a case of a color printer which forms an image by superimposing a plurality of colors to obtain a clear image, a high pressure in a predetermined range must be uniformly applied to both pressure and heat rollers. Thus, both the heat roller 110 and the pressure roller 120 are coated with the silicon rubber layers 112 and 122, respectively.

Figure 6:
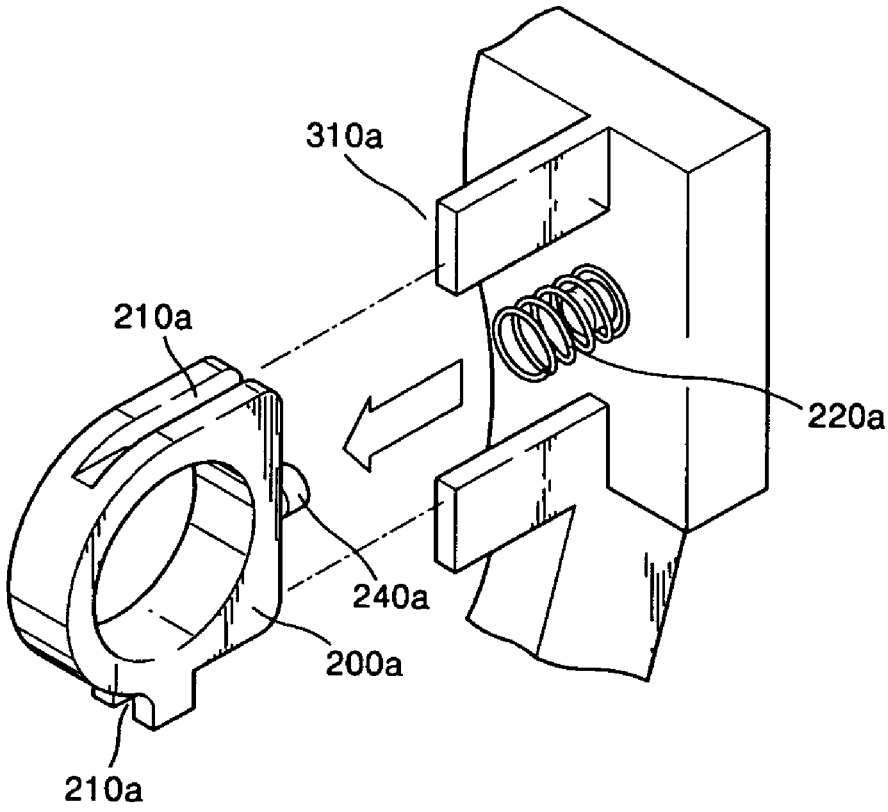
FIG. 6 illustrates a combination structure of a bearing and a frame in the fusing unit shown in FIG. 4.

The heat roller 110 and the pressure roller 120 are coupled via a gear pair 230 and rotated while being respectively supported in frames 300*a* and 300*b*. In this structure, plastic mold bearings 200*a* and 200*b* are used to rotatably support the heat roller 110 and the pressure roller 120 to center on corresponding portions of the frames 300*a* and 300*b*. The plastic mold bearings 200*a* and 200*b* are manufactured by injection-molding polyphenylen sulfide (PPS) resin. The PPS resin is made of high strength, chemical-resistant, and dimensionally stable, engineering plastics that can be used at a high temperature of about 200° C. The plastic mold bearings 200*a* and 200*b* can be manufactured to have a variety of shapes, unlike in conventional metallic ball bearings. Thus, a combination structure of the plastic mold bearings 200*a* and 200*b* and the frames 300*a* and 300*b* can be very conveniently and freely designed. For example, as shown in FIGS. 4 and 6, combination grooves 210*a* and 210*b* are respectively formed in the plastic mold bearings 200*a* and 200*b*, and combination ribs 310*a* and 310*b* are formed on the frames 300*a* and 300*b* to be inserted in the combination grooves 210*a* and 210*b*, respectively, such that the combination structure of the plastic mold bearings 200*a* and 200*b* is designed by simply engaging the combination grooves 210*a* and 210*b* with the combination ribs 310*a* and 310*b*.

Figure 2:
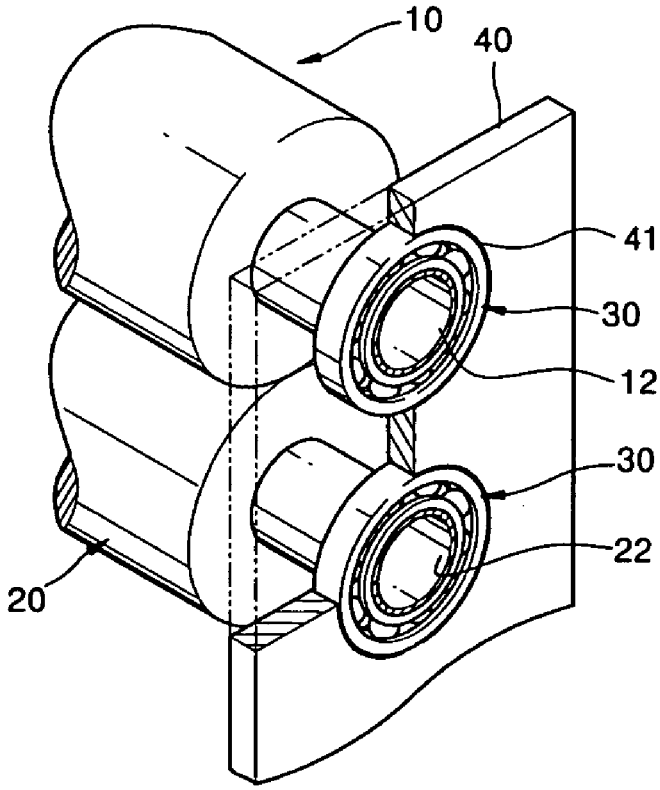
FIG. 2 (PRIOR ART)
FIG. 2 shows a partially-cut view of the conventional fusing unit shown in FIG. 1.

When the combination structure of the fusing unit 100 according to an aspect of the present invention is embodied using conventional metallic ball bearings, it is very difficult to process the combination grooves 210*a* and 210*b* of the combination structure. As such, productivity is lowered, and costs increase. That is, in a conventional structure as shown in FIG. 2, the hole 41 is formed on the frame 40 to correspond to the metallic ball bearings 30 so that the metallic ball bearings 30 are combined with the frames 40. As such, the size of the frame 40 is increased, and a space to install other structures becomes more narrow. However, since the bearings 200*a* and 200*b* formed of plastic mold are used in the fusing unit 100 according to an aspect of the present invention, a working burden is decreased, and the shape of the bearings 200*a* and 200*b* can be easily modified according to an installation space within the fusing unit 100 or the color laser printer. In addition, the combination structure of the frames 300*a* and 300*b* can be modified in various shapes suitable for a narrow space, like the combination grooves 210*a* and 210*b* and the combination ribs 310*a* and 310*b*. Here, strength to maintain pressure applied to the heat roller 110 and the pressure roller 120 remains lower than the strength of the metallic ball bearings 30 of FIG. 2. However, in a case of a fusing unit used with a color laser printer using the above structure, when a unilateral compressive load that acts between the heat roller 110 and the pressure roller 120 during fusing is between 5.5 and 11.5 kgf, and thicknesses and widths of bearings are more than 3 mm, a problem caused by reduction in strength does not occur even though the plastic mold bearings 200*a* and 200*b* are used.

Here, the unilateral compressive load is a load that acts on one end of the heater roller 110 and the pressure roller 120 which are engaged with each other. The unilateral compressive load becomes a load that acts on the bearings. According to an experimental result in which the unilateral compressive load is between 6–8 kgf and a surface temperature of the heat roller 110 and the pressure roller 120 is set to 180° C., no problems occur until 250,000 sheets of paper having a A4 size are printed. This means that the fusing unit formed according to an aspect of the present invention has a sufficient strength considering that a standard life span of the fusing unit is generally 100,000 sheets of paper. In other words, when the unilateral compressive load is lower than 5.5 kgf, a paper fusing property is lowered, and when the unilateral compressive load is higher than 11.5 kgf, mold bearings are deformed, and it is difficult to use the mold bearings. However, the mold bearings exhibit a sufficient performance within the above range of 5.5 kgf to 11.5 kgf. Table 1 shows a measurement result of a driving torque of a fusing unit using plastic mold bearings. In addition, Table 2 shows a measurement result of a variation in weight of the plastic mold bearings according to the number of sheets.

TABLE 1

| Number of sheets (1000 sheets) | Initial stage | 1 | 2 | 6 | 10 | 30 |
|---|---|---|---|---|---|---|
| Torque (Kgfcm) | 4.2 | 3.0 | 3.0 | 3.0 | 3.0 | 3.0 |
| Number of sheets (1000 sheets) | 50 | 90 | 100 | 101 | 110 | 150 |
| Torque (Kgfcm) | 3.0 | 4.0 | 4.1 | 3.0 | 2.8 | 3.8 |

TABLE 2

| | Initial stage | 100,000 sheets | 150,000 sheets | Amount of wear |
|---|---|---|---|---|
| Sample #1 | 5.30 | 5.290 | 5.290 | 0.010 |
| Sample #2 | 5.30 | 5.300 | 5.290 | 0.010 |
| Sample #3 | 5.30 | 5.298 | 5.228 | 0.072 |
| Sample #4 | 5.302 | 5.302 | 5.300 | 0.002 |
| Average | 5.3005 | 5.2975 | 5.277 | 0.0235 |

It can be known from Table 1 that a driving torque of about 4.2 Kgfcm at an initial stage is stabilized to about 3.0 Kgfcm. The driving torque is temporarily increased to 4.0 Kgfcm at the number of sheets of about 90,000–100,000 by replacing a cleaning pad to clean the heat roller 110 and the pressure roller 120. It can be known from Table 2 that a weight variation after 150,000 sheets are printed is about 0.4% on the average, and in consideration of the average life span of the fusing unit of 100,000 sheets, the fusing unit has a sufficient wear-resistant property.

Thus, a fusing operation of an image transferred onto a sheet of paper can be easily performed while the heat roller 110 and the pressure roller 120 rotate with being supported by the plastic mold bearings 200*a* and 200*b* that can be easily manufactured and assembled.

Figure 7:
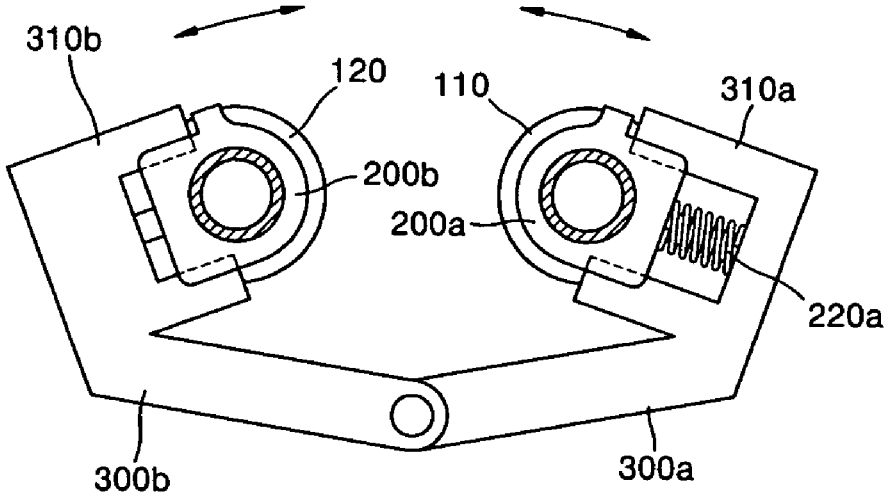
FIG. 7 illustrates an example of a structure that can be used to attach and detach the heat roller and the pressure roller in the fusing unit shown in FIG. 4 according to another embodiemnt of the present invention.

The frame 300*a* which accommodates the heat roller 110 is rotatably coupled with the frame 300*b* which accommodates the pressure roller 120, as shown in FIG. 7. Thus, when the bearings 200*a* and 200*b* of the heat roller 110 and the pressure roller 120 are fixed and the frames 300*a* and 300*b* are rotated, the heat roller 110 and the pressure roller 200 closely contact each other.

Figure 8:
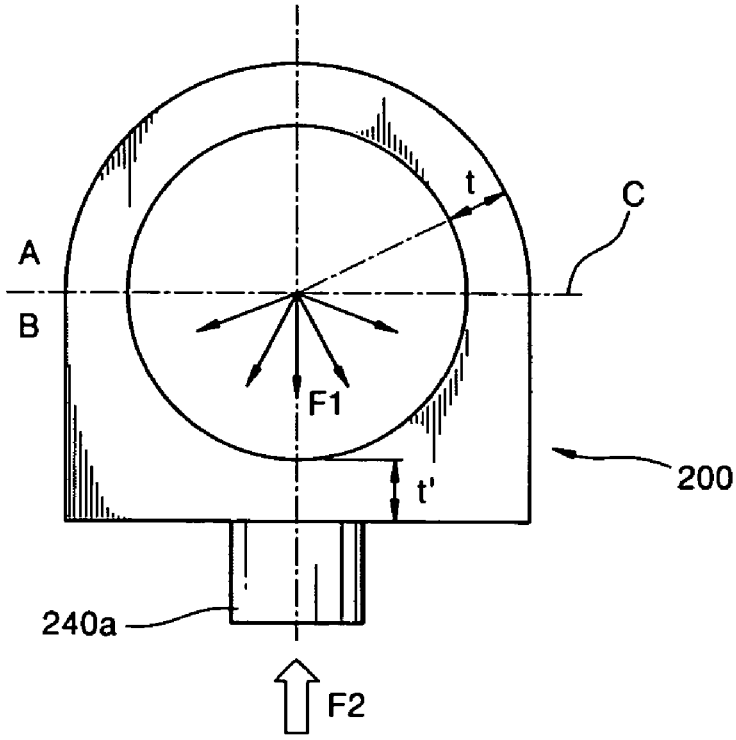
FIG. 8 illustrates a relationship between upper and lower thicknesses of the bearing shown in FIG. 4.

The bearings 200*a* and 200*b* can be divided into a lower region B, in which a spring guide applying portion, i.e., a spring guide protrusion 240*a*, is formed, and an upper region A which is opposite to the lower region B, based on a center line C perpendicular to a direction in which a spring pressure F2 acts, as shown in FIG. 8. Most of unilateral compressive load F1 acts in the lower region B. Thus, preferably, a thickness t' of the lower region B is at least the same as or greater than an effective thickness t ($t' \geqq t$) obtained in a radial direction of the upper region A. In addition, the spring guide protrusion 240*a* is also used to reinforce the lower region B with strength.

As described above, the fusing unit for a color laser printer according to the present invention has the following advantages.

First, plastic mold bearings that can be manufactured to have a variety of shapes are used as a member which supports fusing rollers, such that a combined structure to support bearings in a frame is easily formed in a narrow space. Second, since plastic mold bearings are cheaper than conventional metallic ball bearings, printer manufacturing costs are reduced. Third, in particular, in products that can be easily purchased and used by users, such as color laser printers, the above advantages are very useful to manufacture low-priced small printers that satisfy users' needs.

While this invention has been particularly shown and described with reference to preferred embodiments thereof, it will be understood by those skilled in the art that various changes in form and details may be made therein without departing from the spirit and scope of the invention as defined by the appended claims and equivalents thereof.

What is claimed is:

1. A fusing unit used with a color laser printer, the fusing unit passing a sheet of paper onto which an image is transferred between two rollers that closely contact each other to be rotated, heating and pressing the transferred image, and fusing the heated and pressed image on the sheet of paper, wherein the two rollers have a silicon rubber layer to cover outer circumferences thereof and are rotatably supported to be centered on frames by interposing bearings between the two rollers and frames, and the bearings are plastic mold bearings.

2. The fusing unit of claim 1, wherein the frames comprise combination ribs provided therein, and the bearings comprise combination grooves that slide into and are coupled with the respective combination ribs, such that the bearings are fixed in the frames by inserting the combination ribs in the combination grooves.

3. The fusing unit of claim 1, wherein the two rollers receive a unilateral compressive load to form pressure between the two rollers, and the unilateral compressive load is between 5.5 and 11.5 kgf during a fusing operation.

4. The fusing unit of claim 1, wherein the frame comprises a spring guide applying portion having a spring to apply an elastic force in a direction in which the two rollers are closely attached to each other based on a coupling of the frames.

5. The fusing unit of claim 4, wherein when the bearings comprise a first region, in which the spring guide applying portion is formed, and a second region which is disposed opposite to the first region, based on a center line perpendicular to a direction in which the elastic force of the spring acts, a thickness of the first region is the same as or greater than a thickness of the second region.

6. The fusing unit of claim 4, wherein the spring guide applying portion comprises a spring guide protrusion with which an end of the spring is coupled.

7. The fusing unit of claim 6, wherein the spring guide protrusion is used to reinforce the lower region with strength.

8. A color laser printer, comprising:

an exposure unit which forms an electrostatic latent image on a photosensitive body;

a developing unit which forms the electrostatic latent image by predetermined color toners;

a transfer unit which transfers the developed image onto a sheet of paper; and a fusing unit which passes the sheet of paper onto which the image is transferred between two rollers that are closely attached and rotated, heats and presses the transferred image, and fuses the heated and pressed image, wherein the two rollers have a silicon rubber layer to cover outer circumferences thereof and are rotatably supported to be centered on frames by interposing bearings between the two rollers and frames, and the bearings are plastic mold bearings.

9. The color laser printer of claim 8, wherein the frames comprise combination ribs provided thereon, and the bearings comprise combination grooves that slide into and are coupled with the combination ribs, such that the bearings are fixed in the frames by inserting the combination ribs in the combination grooves.

10. The color laser printer of claim 8, wherein the rollers receive a unilateral compressive load having a pressure during a fusing operation in a range between 5.5 and 11.5 kgf.

11. The color laser printer of claim 8, wherein the fusing unit comprises a spring guide applying portion having a spring that applies an elastic force in a direction in which the two rollers are closely attached to each other, based on a method of coupling the frames.

12. The color laser printer of claim 11, wherein when the bearings comprises a lower region, in which the spring guide applying portion is formed, and an upper region which is opposite to the lower region, based on a center line perpendicular to a direction in which the elastic force of the spring acts, a thickness of the lower region is the same as or greater than a thickness of the upper region.

13. The color laser printer of claim 11, wherein the spring guide applying portion comprises a spring guide protrusion with which an end of the spring is coupled.

14. The color laser printer of claim 13, wherein the spring guide protrusion is used to reinforce the lower region with strength.

15. A fusing unit used with a color printer, comprising:

a frame having first and second supporting ends;

a first fusing roller having ends supported by the first and second supporting ends to rotate;

a second fusing roller having ends supported by the first and second supporting ends to be in close contact with the first fusing roller to rotate;

first plastic mold bearings disposed between the first fusing roller and the first and second supporting ends of the frame; and second plastic mold bearings disposed between the second fusing roller and the first and second supporting ends of the frame, wherein the two rollers receive a unilateral compressive load to form pressure between the two rollers, and the unilateral compressive load is between 5.5 and 11.5 kgf during a fusing operation; and wherein the first and second plastic mold bearings comprise first portions disposed between longitudinal axes of the first and second plastic mold bearings to have a first thickness in a direction perpendicular to the longitudinal axes, and second portions disposed outside the longitudinal axes of the first and second plastic mold bearings to have a second thickness in a direction perpendicular to the longitudinal axes, the second thickness being thicker than the first thickness.

16. The fusing unit of claim 15, further comprising:

one or more springs disposed between the first and second supporting ends and the first plastic mold bearings.

17. The fusing unit of claim 15, wherein the first and second supporting ends each comprise a combination rib formed in a direction perpendicular to the longitudinal axes of the first and second plastic mold bearings, and the first and second plastic mold bearings each comprise a combination groove formed in a direction perpendicular to the longitudinal axes of the first and second plastic mold bearings to be coupled to the combination.

18. The fusing unit of claim 15, wherein a thickness and width of the bearings are more than 3 mm.

19. A fusing unit to fuse color images on a recording medium, comprising:

first and second fusing rollers;

first and second frames having ribs to hold the first and second fusing rollers, respectively, in elastically pressing contact; and plastic molded bearings to rotatably support each of the first and second fusing rollers within a center of the respective first and second frames, wherein the plastic molded bearings each comprise grooves to fit into the respective ribs of the first and second frames; and wherein the two rollers receive a unilateral compressive load to form pressure between the two rollers, and the unilateral compressive load is between 5.5 and 11.5 kgf during a fusing operation.

20. The fusing unit of claim 19, wherein the ribs of the first and second frames are positioned at respective ends thereof and combine with the respective grooves positioned at each end of the first and second fusing rollers.

21. The fusing unit of claim 19, wherein a thickness and width of the bearings are more than 3 mm.

22. A fusing unit usable with an image forming apparatus, comprising:

a first roller and a second roller to fuse an image to a print medium;

a first frame disposed along a longitudinal direction of the first roller to support the first roller;

a second frame disposed along a longitudinal direction of the second roller to support the second roller;

at least one first non-metal bearing disposed on at least one end of the first roller and being engaged by the first frame; and at least one second non-metal bearing disposed on at least one end of the second roller being engaged by the second frame, wherein the two rollers receive a unilateral compressive load to form pressure between the two rollers, and the unilateral compressive load is between 5.5 and 11.5 kgf during a fusing operation;

the first frame and second frame having ribs to hold the first roller and second roller, respectively, in elastically pressing contact, and wherein the non-metal bearings each comprise grooves to fit into the respective ribs of the first and second frames.

23. The fusing unit of claim 22, wherein the first and second frames are disposed opposite each other with respect to the first roller and the second roller to apply a force on a rear of the first and second rollers, respectively, to push the first and second rollers toward each other.

* * * * *